United States Patent [19]

MacCarthy

[11] 4,442,625

[45] Apr. 17, 1984

[54] TAPE-SUPPORTED SLEEPER YO-YO

[76] Inventor: Patrick MacCarthy, 37 Mines Park, Golden, Colo. 80401

[21] Appl. No.: 298,720

[22] Filed: Sep. 2, 1981

Related U.S. Application Data

[63] Continuation-in-part of Ser. No. 138,729, Apr. 9, 1980, Pat. No. 4,290,224.

[51] Int. Cl.[3] ..... A63H 27/12

[52] U.S. Cl. ..... 46/61

[58] Field of Search ..... 46/61, 64, 67, 70, 71

[56] References Cited

U.S. PATENT DOCUMENTS 2,629,202 2/1953 Stivers et al. ..... 46/61

2,975,547 3/1961 Greve ..... 46/61

OTHER PUBLICATIONS

"Experimental Fun with the Yo-Yo and Other Science Projects"; Renner; Al G.; Dodd, Mead & Co., N.Y. ©1979.

*Primary Examiner*—Mickey Yu

*Attorney, Agent, or Firm*—Oblon, Fisher, Spivak, McClelland & Maier

[57] ABSTRACT

A toy capable of combined rotational motion about a horizontal axis and translational motion in a vertical direction. Two parallel discs are connected through their centers by a single axle. The axle is supported from a string connected at a position between the two discs. The string is connected to one end of a tape. A swivel system is attached to the other end of the tape, and a ring for holding the toy is attached to the swivel system. The string may be anchored to the axle in a non-sleeping mode, or it may be looped around the axle allowing the yo-yo to sleep. In order to operate the toy, the user's finger is placed in the ring and an up-and-down motion is initiated.

15 Claims, 4 Drawing Figures

TAPE-SUPPORTED SLEEPER YO-YO

CROSS REFERENCES

This application is a continuation-in-part of my copending U.S. patent application Ser. No. 138,729, which was filed Apr. 9, 1980 and entitled "Tape-Supported Yo-Yo", new U.S. Pat. No. 4,290,224, and my copending U.S. patent application Ser. No. 293,797 now allowed entitled "YO-YO WITH TWIST-RESISTANT STRING" filed on Aug. 18, 1981, both of which are incorporated herein by reference.

FIELD OF THE INVENTION

This invention relates to the field of rotating toys. More specifically, the invention relates to a tape and tape-cum string supported yo-yo consisting of a tape connected at one of its ends to an axle or a string, which is in turn connected to the axle of the yo-yo.

BACKGROUND OF THE INVENTION

Various toys having combined rotational motion about a horizontal axis and a translational motion in a vertical direction are known. One type of such toy is commonly referred to as a yo-yo. This toy has also been referred to as a return top; quiz; Prince of Wales' toy; disc; Coblenz; Incroyable; Bandalore; or emigrette. According to the Patent Office classification, a yo-yo is a tethered aerial top. A conventional yo-yo consists of a single axle having two parallel positioned discs centrally connected to the axle. A string is connected to the axle between the discs at one end and is held in the use's hand at the other end. The string is wrapped around the axle by the user and the yo-yo is then forced downward. Upon being forced downward, the string unwinds and provides a rotational momentum to the discs. Once the string has been completely unwound, the rotational momentum of the discs continues to exist, thus causing the string to be rewound around the axle as it travels upward vertically toward the user's hand. The conventional structure of this yo-yo is disclosed within U.S. Pat. No. 3,263,361 to Bowden, and U.S. Pat. No. 3,256,635 to Radovan.

In another variation of the yo-yo, the string is not actually secured to, or anchored to, the axle; rather, it is looped about the axle somewhat loosely, allowing the yo-yo body to spin freely in the looped string. Such rotational motion of a yo-yo, unaccompanied by translational motion along the string direction, is referred to as "sleeping". The sleeping yo-yo can be withdrawn from its sleep by jerking the string, or alternatively, by relaxing the tension in the string. The conventional sleeper-type yo-yo is discussed in the specification of Stivers and Ennis, U.S. Pat. No. 2,629,202. Another mechanism for allowing a yo-yo to sleep, but which does not involve a looped string, is discussed in Isaacson, U.S. Pat. No. 3,175,326. Isaacson's device involves an axle which is rotatably supported in a ballbearing system.

The conventional yo-yo structure as described above has achieved tremendous success in the past as an entertaining toy. Furthermore, certain modifications of that conventional yo-yo such as that disclosed within Bowden or Isaacson may have achieved success as entertaining toys. However, the conventional yo-yo structure has a pronounced limitation when used by inexperienced or younger operators. The limitation is apparent to even the most casual observer and resides in the ability to maintain the balance or equilibrium of the toy during use. The inability of the inexperienced user to maintain this balance results in a wobbling and precessional motion of the yo-yo during operation. The operator loses control of the yo-yo when the balance of the toy is disturbed, thus causing the yo-yo to slow its rotational motion and thereby lose its ability to maintain vertical translational motion.

In the context of this specification, the term "stability of yo-yo" is intended to mean the tendency of the yo-yo axle to remain in horizontal alignment during an up-down translational motion of the yo-yo body, and its tendency to return to this alignment if it is displaced therefrom by some means. The term "stability of yo-yo" also refers to the facility with which proper yo-yo operation can be re-established after it experiences wobbling or precessional rotation; the greater the stability of the yo-yo, the easier it is to re-establish proper operation after it encounters difficulty.

SUMMARY OF THE INVENTION

The presently claimed invention is comprised of a single axle which connects two parallel discs at their centers. A tape is connected at one of its ends to a string, which is in turn, connected to the axle, between the discs. In order to operate the yo-yo, the user must support the tape at its other end and move that end gently up and down.

The resistance to twisting, exhibited by the tape, counteracts the precessional rotation of the yo-yo body. Interestingly, this resistance is effective even when the device is supported from a swivel system; in fact, the inclusion of a swivel system is found to improve the overall performance of the device, by facilitating the removal of the few twists which might occur in the tape and/or string.

In a preferred embodiment of the present invention a holding ring is attached to the swivel system. In order to operate the preferred embodiment of the present invention, the user places his finger through the holding ring. After winding the combination of the tape connected to the string (hereinafter referred to as tape-cum-string) around the axle, the body of the yo-yo is allowed to fall. Thereafter, gentle up and down oscillatory motion is maintained to keep the body of the yo-yo rotating, and thus sustaining its vertical up-and-down motion. The swivel system, consisting of one or more swivels, allows relaxation of the rotational tension in the tape and/or string resulting from twisting of the tape about a vertical axis. This significantly facilitates operation of the toy.

In accordance with the above-presented description of the invention, and a further description which will follow, it is a primary object of this invention to provide a toy comprised of an axle; two discs supported at their center points on said axle; a ribbon or a tape connected at one of its ends to a string which is in turn connected to said axle.

Another object of the present invention is to provide a yo-yo which is comprised of an axle; two discs supported at their center-points on said axle; a tape, ribbon or belt, connected at one of its ends to a string which is in turn looped about said axle.

Another object of the present invention is to provide a yo-yo which is comprised of an axle; two discs supported at their center-points on said axle, and a tape looped about said axle.

Another object of the present invention is to provide a yo-yo comprised of an axle; two discs supported at their center-points on said axle; a tape connected at one of its ends to a string which is in turn connected to said axle; a system of one or more swivels connected to the opposite end of said tape; a holding ring attached to said swivel system.

Another object of the present invention is to provide a yo-yo toy that is more stable than a conventional yo-yo toy.

Still another object of the present invention is to present a yo-yo toy which is simple in design and in construction.

Another object of the invention is to present a yo-yo toy which possesses such greatly increased stability that it results in increased versatility of the function of the toy.

Another object of the present invention is to present a yo-yo toy of such design that difficulties due to precessional rotation can be readily rectified and proper yo-yo operation reinstated without having to stop the yo-yo and start all over again.

Yet another object of the present invention is to present a yo-yo toy which lends itself to further ornamental and decorative features, by incorporating various designs and patterns on the tape, thus giving the device a more colorful and attractive appearance.

Another object of the present invention is to provide a yo-yo toy possessing the above-listed characteristics and which, in addition, is capable of sleeping.

Still another object of the present invention is to present a yo-yo toy with diminished friction between the support means and the inner walls of the discs.

Another object of the present invention is to present a yo-yo toy which offers enhanced atmospheric resistance to precessional rotation.

These and other objects and advantages of the present invention will become apparent to those skilled in the art upon reading the details of construction and use as more fully set forth below, reference being made to the accompanying drawings forming a part hereof wherein like numerals refer to like parts throughout.

DESCRIPTION OF THE PREFERRED EMBODIMENT

Before the present tape-supported sleeper yo-yo is described, it is to be understood that this invention is not limited to the particular arrangement of parts shown, as such devices may, of course, vary. It is also to be understood that the terminology used herein is for the purpose of describing particular embodiments only and is not intended to be limiting.

Figure 1:
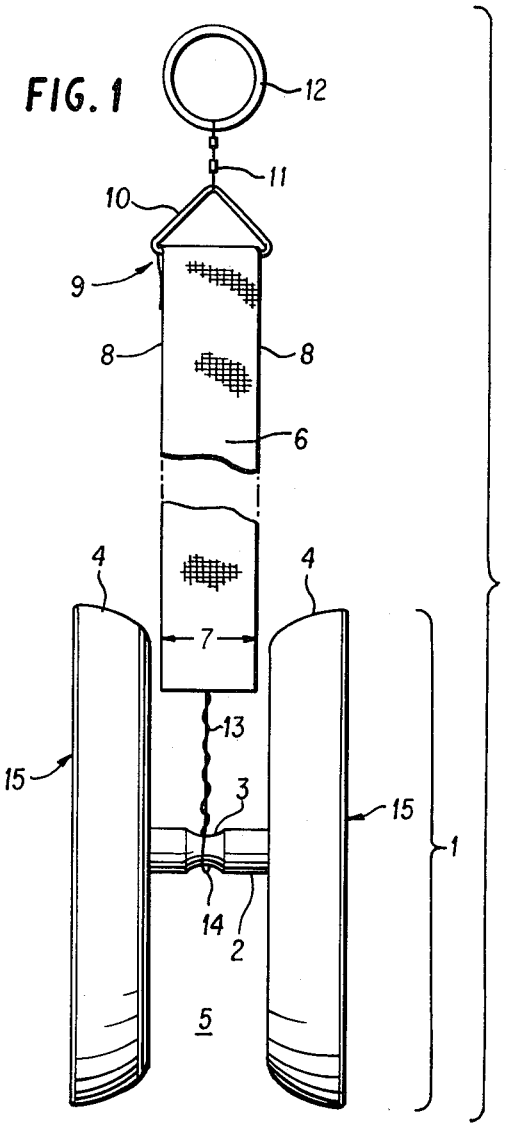
FIG. 1 is a plan front view of the present yo-yo toy.

Referring now to the drawings, and to FIG. 1 in particular which shows a plan front view of the present invention. The body of the yo-yo is referred to generally by the number 1. The body contains a single axle 2. The axle 2 may contain a circular recess or groove 3, which is centrally located and circling the axle 2. The axle 2 has a pair of identical discs 4 positioned at their center points on the axle 2. The discs 4 are typically circular in cross-section and are separated from each other, leaving a groove 5 between the two discs 4. The discs 4 may be hollow or solid, and their faces may be flat or curved.

A flat ribbon, belt or tape 6, of width 7, is connected at one of its ends to a string 13 which is looped 14 about the axle 2. The groove 3 retains the looped string 14 centrally positioned on the axle 2. This type of groove in the axle is found in some commercially available yo-yos, and is described by Stivers and Ennis, U.S. Pat. No. 2,629,202. In one modification of the present invention, the groove 3 may be sufficiently large to accommodate all of the string 13 segment when it is wound around the axle 2; in this case the tape 6 lies flatly on top of the axle 2 surface.

A fold 9 is placed at the other end of the tape 6 by folding the tape 6 over upon itself. This fold is maintained by sewing; weaving; stapling; gluing, etc. A loop 10 passes within the fold 9. A swivel system 11, containing one or more swivel members, is connected to the loop 10. The swivel system 11 allows for rotational motion of the support 10 and the attached tape 6, string 13 and yo-yo body 1. The swivel system 11 also facilitates the removal of twists from the tape 6, and string 13 if the tape 6 or string 13 become twisted about a vertical axis. For brief periods of play, a short string segment may suffice as the swivel means 11; however, a string segment which offers little torsional resistance to twisting must be chosen for this purpose.

A ring 12, for holding the yo-yo, is connected to the swivel system 11. The entire device may be held by the user by placing a finger through the ring 12.

The tape 6 may be comprised of any of a wide variety of flat elongated material, natural or synthetic. The tape 6 may have parallel sides as shown within FIG. 1, or the sides of the tape 6 may be non-parallel. The tape 6 may have a woven texture or it may consist of a non-woven material. However, the inventor has discovered that grosgrain tape or ribbon is particularly well adapted for use in connection with the present invention. Furthermore, the torsional resistance of preferred tapes are described in detail below. Grosgrain tape is characterized by having a corrugated pattern with ridges and grooves normal to the sides 8 of the tape 6. This type of tape exhibits a significant resistance to twisting about its longitudinal axis, compared to most cloth tapes. Consequently, when the grosgrain tape is forcibly twisted, it has a strong tendency to become untwisted again. If, during operation of the yo-yo it is swung to the side, along a direction parallel to its axis 15—15, it will undergo a severe gyroscopic precession about the vertical axis.

The twisting which is induced in the tape as a result of this precessional rotation is readily and rapidly undone by the propensity of the grosgrain tape to exist in an untwisted configuration. This untwisting is partially effected through the induced rotation of the yo-yo body 1 in the opposite direction to the twisting originally caused by the precession. Most importantly, the swivel system 11 is very effective in relieving these twists, as a result of the torque caused by the twisted grosgrain tape. Another advantage of the grosgrain tape is its ability to remain straight along its width 7, and to resist wrinkling or warping along this dimension. Furthermore, if the tape is forced to become twisted about a vertical axis, resulting in the tape adopting a 'spiral staircase' type of configuration, the corrugated lines still remain in horizontal alignment, thus maintaining the axle 2 of the yo-yo in a horizontal orientation.

Figure 4:
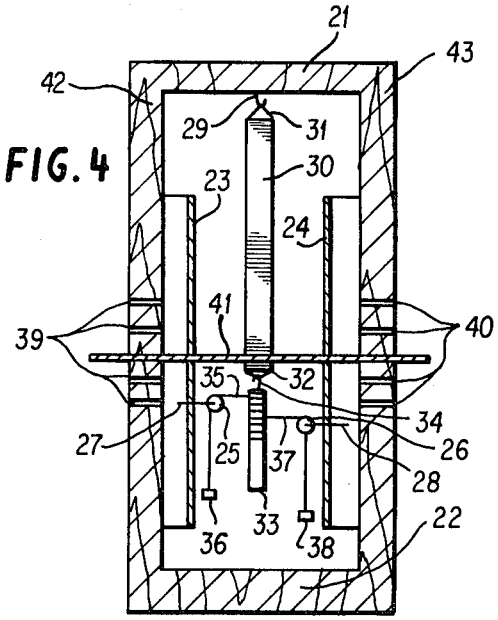
FIG. 4 illustrates an apparatus which was constructed to measure and compare the torsional resistance to twisting.

In order to quantify the torsional resistance to twisting of various tapes, an apparatus of the type illustrated in FIG. 4 was designed and constructed. The members 42 and 43 are vertical supports joined by an upper connector 21 and a lower connector 22. The members 23 and 24 are vertical bars which are connected to supports 42 and 43, respectively. Pulleys 25 and 26 are slidably connected to bars 23 and 24 by means of clamps 27 and 28, respectively. Hook 29 in upper connector 21 supports the tape 30 by means of a triangular support 31, through which the tape is looped and stapled. The tape 30 has a lightweight triangular support 32 suspended from the lower end of the tape. The tape 30 is connected, through the lower triangular support 32, to a lightweight cylindrical rod 33 of known diameter by means of a hook 34 which is screwed into rod 33. A light thread 35 is connected to cylindrical rod 33. This thread 35 lies in the groove of the pulley 25, and there is a known mass 36 suspended from the thread 35. A thread 37 is attached to rod 33 on the opposite side of attachment as thread 35. Thread 35 and thread 37 are attached to rod 33 close to each other but at slightly different heights, as indicated in FIG. 4. Thread 37 lies in the groove of pulley 26 and has a known mass 38 suspended from it. Weights 36 and 38 are identical. Two series of parallel holes 39 and 40 are arranged in a vertical sequence along support members 42 and 43. The plane containing these sets of holes lies slightly in front of the plane containing the bars 23 and 24. A removable pin 41 can be supported at opposite ends in a corresponding pair of these holes.

The apparatus is operated as follows: the tape under study is supported from the hook 29 as indicated above. While disconnected from the tape, the rod 33 is manually twisted a specified number of revolutions in a chosen direction, let's say, clockwise as one looks down on the rod from the top. This causes the threads 35 and 37 to wrap around the rod 33 in the same direction, thereby forcing the two weights 36 and 38 to rise. These weights exert a torque or moment on the rod 33 tending to rotate it in the opposite direction to the initial imposed rotation. After the rod 33 has been rotated a specified number of times, it is connected to the tape 30 through the lower triangular support 32 and hook 34. The torque applied by the two weights 36 and 38 causes the rod 33 to rotate in an anticlockwise direction as viewed from above, thus causing the tape to be twisted in this direction also. The rod 33 continues to rotate until the opposing torque offered by the twisted tape is exactly equal in magnitude to the torque due to the suspended weights 36 and 38, at which point equilibrium is reached. If the threads 35 and 37 become completely unwrapped from rod 33 during this process, the same step is repeated again, by disconnecting the rod 33 from the tape 30 and again rotating the rod 33 manually in a clockwise direction, as viewed from the top. During this rewinding, the twisted tape is prevented from untwisting by insertion of the pin 41 into the lower triangular support 32, while the pin 41 is supported in the holes 39 and 40.

The total weight suspended from the tape 30 is given by the sum of the weights of the lower triangular support 32, the hook 34 and the rod 33.

The torque or moment applied to the rod 33 by the weight 36 is given by the product of the weight 36 and the radius of the rod 33. A similar torque is applied by the weight 38. Since both weights are equal, and since both torques act in the same direction, the total torque is given by the product of one of the weights by the diameter of the rod. The weights of the threads and the radius of the threads are ignored in these calculations due to their very small contributions to the overall measurements. The end-to-end distance of tapes generally becomes smaller during twisting; accordingly, clamps 27 and 28 allow the positions of the pulleys 25 and 26 to be adjusted so that the segment of thread 35 between rod 33 and pulley 25, and also the segment of thread 37 between rod 33 and pulley 26, are horizontal prior to taking final measurements.

When a tape is twisted slightly, it produces a "spiral staircase" type of configuration. However, if it is twisted excessively, this configuration collapses and the tape folds over in a pronounced manner along its width. Tapes differ considerably in their resistance to this type of collapse, that is, in their inherent torsional resistance to twisting. When this type of structural collapse occurs, the tape loses a significant portion of its torsional resistance to twisting. When there is a weight supported from the lower end of the tape, that is, if the tape is under tension, its total torsional resistance increases; in other words, this collapse does not occur until a greater torque is applied to the system. However, this is not due to the inherent twist-resistance residing in the tape material itself, but is due in large part to the imposed tension. Accordingly, in these experiments, it was desirable to have the tension on the tape as small as possible by having the total suspended weight from the tape as small as practicable.

The torsional resistance of various tapes were compared by gradually increasing the two weights 36 and 38, that is, by gradually increasing the torque applied to a fixed length of tape and noting:

(i) How many rotations are induced in the tape by each applied torque, and (ii) What magnitude of torque first causes structural collapse of the tape.

The weights 36 and 38 can be varied conveniently by tying small plastic bags to the ends of the threads 35 and 37; known masses can then be added to, and removed from, these bags.

In all of these experiments, a rod 33 of 0.25 inch diameter was used; the plastic bags weighed 0.19 gram each. The lower support 32 in these experiments weighed 0.37 gram, and the rod 33 plus attached hook 34 had a weight of 2.08 grams. Thus, the tension in the tape, due to the suspended weight of support 32, rod 33 and hook 34, had a value of 2.45 grams.

The measured data for a number of tape materials are presented in Table I. The third column in Table I gives the number of rotations induced in each tape by a specified torque, for example 1.2/0.3 means that the tape displayed a total of 1.2 twists from top to bottom when it was subjected to a torque of 0.3 gram inch. Column 4 specifies the minimum torque which causes the "spiral staircase" configuration of the twisted tape to collapse.

All results are the average of at least three separate measurements. Equilibrium was approached from both directions in all experiments in order to compensate for frictional effects within the measuring apparatus. All individual readings fell very close to the average value, indicating good reproducibility and precision for the measurements.

The commercially available tapes of different types had slightly different widths. However, it was possible to choose combinations which had reasonably close dimensions for comparison purposes, for example, the first four tapes listed in Table I have approximately the same width; and the 5th, 6th and 7th tapes listed in Table I are also close to each other in width, allowing valid comparisons to be made.

TABLE I

| TAPE | WIDTH (INCH) | TWISTS/TORQUE (1/GRAM INCH) | COLLAPSE POINT (GRAM INCH) |
|---|---|---|---|
| Satin | 15/16 | 1.2/0.3 | 0.43 |
| Satin | 7/8 | 1.6/0.3; 2.4/0.55 | 0.8 |
| Taffeta Plaid | 31/32 | 1.7/0.3; 2.7/0.55 | 0.6 |
| Grosgrain | 15/16 | 0.9/0.3; 2.05/0.8; 2.92/1.30; 3.93/2.04; 4.6/2.54 | 3.0 |
| MYLAR | 3/4 | 2.5/0.3 | 0.55 |
| Twill Tape | 3/4 | 2.0/0.3 | 0.35 |
| Grosgrain | 11/16 | 1.6/0.3; 3.1/0.8; 4.4/1.30; 5.3/1.8 | 2.2 |

All tapes for these measurements were 42 inches in length from the upper support 31 to the lower support 32.

Many of the common tapes, such as twill tape, Mylar, satin or taffeta plaid, with the dimensions and texture usually found commercially, do not exhibit a pronounced degree of torsional resistance to twisting; accordingly, these materials are not particularly effective for use in conjunction with a yo-yo. As shown by the data in Table 1, a 42 inch segment of typical cloth tapes (satin; taffeta plaid) of widths between 28/32 inch and 31/32 inch cannot withstand a torque of 1.0 gram inch; whereas it requires a torque of 3 gram inch to cause collapse of grosgrain tape of similar dimensions (42 inches long; 15/16 inches wide). Similarly, a 42 inch length of twill tape or mylar, each of 3/4 inch width, cannot withstand a torque of 0.70 gram inch, but a similar grosgrain tape (42 inches in length and 11/16 inches in width) can withstand a torque of 2.2 gram inch before its "spiral staircase" configuration collapses. Although all torsional resistance to twisting is important in connection with this invention, it is most important that the tape not collapse since collapse of the tape during operation makes it nearly impossible to continue smooth yo-yo operation.

Grosgrain tape is particularly effective for use with yo-yos. Of course, the other materials such as twill tape, Mylar, satin, plaid, etc., may become torsional resistant by increasing their thickness above the conventional values or through other modifications of their structure by treatment. The desirable feature of a tape for use in conjunction with a yo-yo is that it possess a significant degree of torsional resistance to twisting. Based on the data in Table I, a ribbon-type material suitable for use as a yo-yo tape should have the following characteristic torsional resistance to twisting: a 42 inch segment of material of width 15/16 inches, and sustaining a suspended weight of 2.45 grams, should withstand a torque of 1.0 gram inch or more without collapse of its "spiral staircase" configuration. A 42 inch segment of the material of width 11/16 inches should withstand a torque of 0.70 gram inch or more without causing collapse of the "spiral staircase" configuration of the twisted tape. However, the inventor has also established that when a swivel system 11 is used in association with the toy, tapes of substantially lesser torsional resistance than those mentioned above may be employed.

The inventor has found that two features of the invention contribute to improved operational ability. These features are: (1) twist resistance of the yo-yo tape and (2) a swivel which releases any twisting which does occur. By testing various embodiments of the invention, the inventor has found that the best results are obtained using twist resistant tape in combination with a swivel. However, good results can also be obtained by using a twist resistant tape alone or by using a swivel in combination with a tape having no particular ability to resist twisting. More particularly, the best results are obtained using a swivel in combination with a tape having a twist resistance such that a 42 inch segment with a width of 15/16 inches and sustaining a suspended weight of 2.45 grams can withstand a torque of 1.0 gram inch or more without collapse. However, good results are obtained using such a tape without a swivel or by using a swivel in combination with a tape having a twist resistance such that a 42 inch segment with a width of 15/16 inches cannot withstand a torque of 1.0 gram inch without collapse. A swivel as referred to herein means any means which will allow for release of the twisting of the tape such as a conventional yo-yo string having very little torsional resistance itself.

The string 13 (not used in place of swivel 11) may be comprised of any of a wide variety of string materials, natural or synthetic. The type of string most conventionally used in conjunction with yo-yos is laid; i.e., it consists of twisted strands. Laid string is particularly suitable for the situation where it must be doubled over to form a loop as in the case of a sleeper yo-yo; the laid string twists about itself in two strands very effectively, to form a loop. This type of string is also very effective in connection with the present invention. However, other types of string, such as braided nylon or twine, hemp, cord, etc., may also be used in association with the present invention.

It should be pointed out that twist-resistant string is particularly effective in connection with the present invention to connect the tape to the axle but not in place of swivel 11. An example of one type of such a material is metallic cord. The use of such twist-resistant strings on a yo-yo, in the absence of a tape segment, is discussed in my copending application, entitled: "YO-YO WITH TWIST-RESISTANT STRING," filed Aug. 18, 1981.

The loop 14 may be formed by doubling the string back upon itself. Alternatively, the loop 14 may be maintained by means of a bowline knot.

In the non-sleeping modification of the yo-yo the string is tied or anchored to the axle, or the string may be simply looped about the axle more than once. In this latter case, the additional friction between the multiply-looped string and the axle prevents the yo-yo from sleeping.

Figure 2:
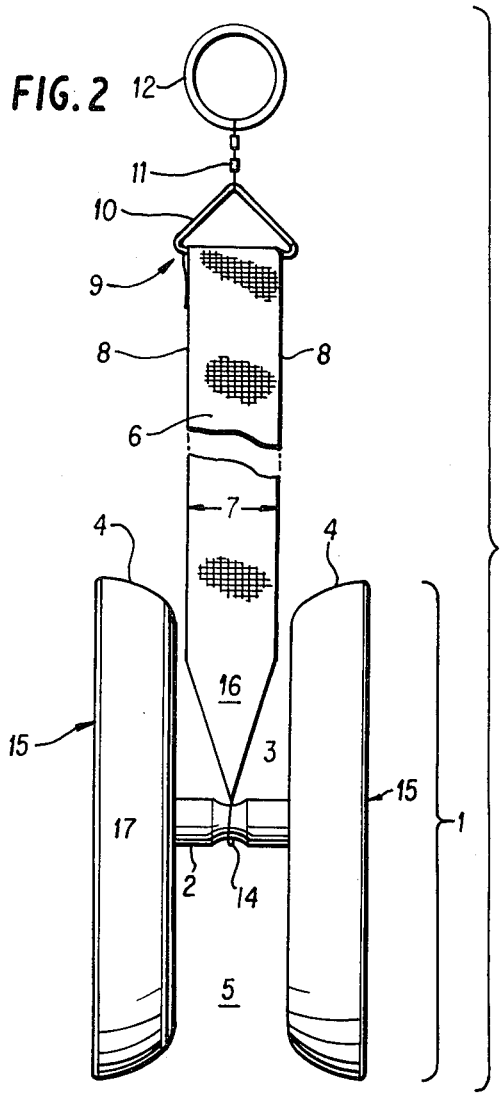
FIG. 2 is a plan front view of another embodiment of the present invention.

In another embodiment of the invention, the yo-yo axle lies in a single loop of the tape which is doubled back upon itself. In order to minimize the friction between the tape and the yo-yo axle, the tape or ribbon may have a tapered cross-section as illustrated in FIG. 2. The tape 6 in FIG. 2 has a tapered segment 16 which merges into a narrow section or string 17 which is looped about the groove 3 in the axle 2.

In the embodiment illustrated in FIG. 1, the string may be connected to the tape in any of various ways, for example, the string may be woven into the tape, or the string may be tied to the tape. Other methods of attachment are also possible including, but not limited to, stapling, gluing, stitching, etc.

Furthermore, the tape may be connected to the axle by more than one string. For example, strings can be attached at either side of the tape along the width or a plurality of strings can be attached along the bottom of the tape along its width.

Figure 3:
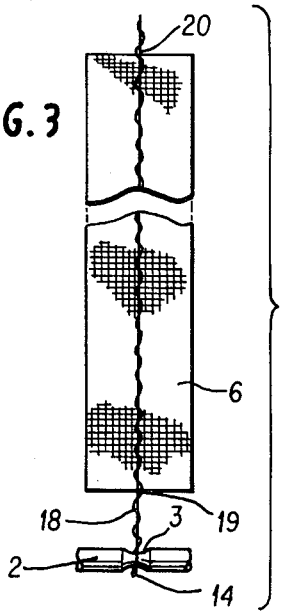
FIG. 3 illustrates another embodiment of the tape-cum-string combination where the looped string passes through the length of the tape.

Alternatively, the string may pass through the length of the tape 6 as illustrated in FIG. 3. The string 18 is looped 14 about the axle 2 and enters the tape 6 at one end 19 passing along the length of the tape 6 and exiting at the opposite end 20. In this modification the tightness of the loop 14 about the axle 2 may be adjusted in a manner similar to that for the conventional sleeper yo-yo.

The yo-yo of the present invention is operated in essentially the same manner as a conventional yo-yo. The string 13 and tape 6 may be wound around the axle 2 of the yo-yo simply wrapping it by hand. In the case of a sleeper, the loop must be sufficiently tight to "catch" on the axle during winding. To initiate operation of the yo-yo, the body 1 of the yo-yo may be held in one hand and the end of the tape 6 or the holding ring 12 may be held in the other hand. The body 1 of the yo-yo is allowed to fall free while still holding one end of the tape 6 or ring 12. As the body 1 of the yo-yo falls under the influence of gravity, the body 1 is forced to rotate about its axle 2, with consequent unwrapping of the tape 6 and string 13 from around the axle 2. When the tape 6 and string 13 have become completely unwound, the body 1 of the yo-yo has acquired considerable angular momentum. In the case where the string is anchored to the axle this angular momentum forces the body 1 of the yo-yo to continue rotating, thus winding the string 13 and tape 6 about the axle 2 in the opposite sense to the manner in which they were wrapped around the axle during the previous downward swing. Consequently, the body 1 of the yo-yo is forced to rise upward again. A gentle upward impulse applied to the tape 6, just prior to the yo-yo body 1 reaching the bottom-most part of its swing, allows the up-down oscillation of the yo-yo body 1 to continue indefinitely. This applied impulse compensates for both frictional loss of energy and dissipation of the translational component of the energy which occurs at the bottom of the yo-yo swing, when the body 1 of the yo-yo is forced to change the direction of its translational motion.

In the case of a sleeper, where the axle lies in the loop 14 of the string or tape, the rotational momentum of the yo-yo body 1 at the bottom of its swing allows the yo-yo to continue rotating in this position, i.e., sleep, until its rotational kinetic energy is dissipated by friction. However, if the rotating yo-yo is brought out of its sleep, the yo-yo body 1 will again travel up along the string, the distance of rise depending on the amount of rotational kinetic energy remaining in the yo-yo. The rotating yo-yo may be brought out of its sleep by jerking the string, or alternatively, by relaxing the tension in the string.

There are three main contributions to the friction in a conventional sleeper yo-yo: (i) friction between the yo-yo body as it rotates about its axle and the atmosphere; (ii) friction between the axle and the string loop; and (iii) friction between the string and the inner walls of the discs. By having the string segment 13 longer than the radius of the discs 4, the friction between the string and the inner walls of the discs is avoided, since the string does not touch the sides of the rotating discs due to the wide groove 5.

A beneficial type of frictional resistance, which is not significant in the conventional yo-yo, exists in the yo-yo of the present invention. When the yo-yo body precesses, it forces the tape to rotate about its longitudinal axis thereby encountering considerable atmospheric resistance to such precessional rotation, helping to stabilize the yo-yo by dissipating the precessional energy. Once precession has stopped, this type of friction is no longer operative, and therefore does not serve to dissipate the energy in the rotational motion about the yo-yo axis. In this respect, one could consider the tape 6 in FIG. 3 to be a baffle, fan or barrier to introduce atmospheric resistance to precession. In order to gain this advantage, the baffle would not necessarily have to be rectangular in shape, but could adopt various other flat shapes which would not interfere with its wrapping about the yo-yo axle. This effect is in addition to the actual resistance to twisting inherent in the tape material itself.

Since the tape 6 automatically winds neatly on top of itself, in a spiralling manner, during the upward swing of the yo-yo body 1, a very smooth motion is experienced by the yo-yo. The tape support diminishes the wobbling normally experienced by a conventional yo-yo, thereby further decreasing the friction between the support and the inner walls of the discs.

The most advantageous feature of the present yo-yo compared to the conventional yo-yos and prior modifications thereof, is its facility to recover, even after experiencing gyroscopic precession. For example, if during operation of the yo-yo it is swung sideways, that is, in a direction parallel to the yo-yo axis 15-15, it experiences a gyroscopic precession about a vertical axis; this behavior is common to all yo-yos and generally results in total loss of control over the yo-yo motion. However, in the case of the yo-yo of the present invention, the twisting of the tape 6, induced by the precessional rotation is rapidly and automatically eliminated.

It is possible to fabricate the body 1 of the yo-yo from a variety of materials, such as wood, plastic, metal, rubber composite, etc. The body 1 of the yo-yo could be molded or turned as one complete unit, or the disc 4 and axle 2 portions could be made separately and then fastened together by various means, including but not limited to gluing, screwing, wedging, soldering, welding, etc. The axle may or may not contain the groove 3.

The inventor has found that a device employing two discs, each of 55 millimeters diameter and separated from each other by 27.5 millimeters by means of an axle of 6 millimeter diameter, to function effectively. The axle contained a groove of 0.5 millimeter depth, around which a looped string was positioned. This string was attached to a tape of 25 millimeter width. The length of the string was such that when the string and tape were fully extended, the end of the tape was 60 millimeters from the axle. The other end of the tape was connected to a swivel system and a holding ring.

The use of a ribbon or tape 6 provides scope for introducing ornamental design features not possible with the conventional string yo-yo. The tape may be made of brightly colored material or multicolored material and may have various designs along its length. The tape or ribbon may also be made from luminous or fluorescent material. These features should make the yo-yo of the present invention more colorful and interesting, and consequently more attractive to children.

The instant invention is shown and described in what is considered to be the most practical and preferred embodiments. It is recognized, however, that departures may be made therefrom, which are within the scope of the invention, and that obvious modifications will occur to one skilled in the art upon reading this disclosure.

What is claimed is:

1. A toy capable of combined rotational motion about a horizontal axis and translational motion in a vertical direction, comprising:

an axle;

a first disc connected at a center point to said axle;

a second disc connected at a center point to said axle;

a string connected at a first end to said axle at a position between said first disc and said second disc;

a torsionally resistant tape connected to a second end of said string.

2. A toy capable of combined rotational motion about a horizontal axis and translational motion in a vertical direction, as claimed in claim 1, wherein said string is connected to said axle by looping said string about said axle.

3. A toy capable of combined rotational motion about a horizontal axis and translational motion in a vertical direction, as claimed in claim 1, wherein said string enters one end of said tape and exits another end of said tape.

4. A toy capable of combined rotational motion about a horizontal axis and translational motion in a vertical direction, comprising: an axle; a first disc connected at a center point to said axle; a second disc connected at a center point to said axle; a string looped about said axle at a position between said first disc and said second disc;

a baffle mounted on said string which offers atmospheric resistance to rotation about an axis positioned along the length of said string.

5. A toy capable of combined rotational motion about a horizontal axis and translational motion in a vertical direction, as claimed in any of claims 1, 2 or 3, wherein said axle includes a circular groove in said axle positioned normal to the axis of said axle.

6. A toy capable of combined rotational motion about a horizontal axis and translational motion in a vertical direction, as claimed in claim 5 wherein said axle includes a circular groove in said axle positioned normal to the axis of said axle.

7. A toy capable of combined rotational motion about a horizontal axis and translational motion in a vertical direction, as claimed in any of claims 1, 2, or 3, further comprising:

a swivel means connected to the other end of said tape.

8. A toy capable of combined rotational motion about a horizontal axis and translational motion in a vertical direction, as claimed in any of claims 3, 4 or 6, further comprising a swivel means connected to the other end of said string.

9. A toy capable of combined rotational motion about a horizontal axis and translational motion in a vertical direction, as claimed in claim 7, further comprising:

a ring for holding the toy, said ring attached to said swivel means.

10. A toy capable of combined rotational motion about a horizontal axis and translational motion in a vertical direction, as claimed in claim 8, further comprising:

a ring for holding the toy, said ring attached to said swivel means.

11. A toy capable of combined rotational motion about a horizontal axis and translational motion in a vertical direction, comprising:

an axle;

a first disc connected at a center point to said axle;

a second disc connected at a center point to said axle;

a tape connected to said axle, said tape having a twist resistance such that about a 42 inch segment with a width of about 15/16 inches, and sustaining a suspended weight of about 2.5 grams, can withstand a torque of 1.0 gram inch or more without collapse.

12. A toy as claimed in claim 11 further comprising a swivel connected to the other end of said tape.

13. A toy capable of combined rotational motion about a horizontal axis and translational motion in a vertical direction, comprising:

an axle;

a first disc connected at a center point to said axle;

a second disc connected at a center point to said axle;

a string tied at one end to said axle at a position between said first disc and said second disc;

a baffle mounted on said string which offers atmospheric resistance to rotation about an axis positioned along the length of said string.

14. A toy capable of combined rotational motion about a horizontal axis and translational motion in a vertical direction, as claimed in claim 13, further comprising:

a swivel means connected to the other end of said string.

15. A toy capable of combined rotational motion about a horizontal axis and translational motion in a vertical direction, as claimed in claim 14, further comprising:

a ring for holding the toy, said ring attached to said swivel means.

* * * * *